US005984664A

United States Patent [19]

Sutton

[11] Patent Number: 5,984,664

[45] Date of Patent: Nov. 16, 1999

[54] APPARATUS FOR PROVIDING AN AIR/FUEL MIXTURE TO A FULLY PREMIXED BURNER

[75] Inventor: David Michael Sutton, Camberley, United Kingdom

[73] Assignee: BG plc, Reading, United Kingdom

[21] Appl. No.: 08/894,876

[22] PCT Filed: Feb. 14, 1996

[86] PCT No.: PCT/GB96/00341

§ 371 Date: Dec. 3, 1997

§ 102(e) Date: Dec. 3, 1997

[87] PCT Pub. No.: WO96/25626

PCT Pub. Date: Aug. 22, 1996

[30] Foreign Application Priority Data

Feb. 16, 1995 [GB] United Kingdom ..... 9503065
Mar. 30, 1995 [GB] United Kingdom ..... 9606537

[51] Int. Cl.[6] ..... F23N 15/00; F23N 1/00; F23N 5/00

[52] U.S. Cl. ..... 431/76; 431/12; 431/18

[58] Field of Search ..... 431/12, 75, 76, 431/18; 236/11, 15 BD

[56] References Cited

U.S. PATENT DOCUMENTS 3,947,217 3/1976 Graat et al. ..... 431/76
4,330,260 5/1982 Jorgensen et al. ..... 431/76
4,396,369 8/1983 Kaessemann ..... 431/76
4,545,009 10/1985 Muraki et al. ..... 431/76
4,586,893 5/1986 Somerville et al. ..... 431/76
4,994,959 2/1991 Ovenden et al. ..... 431/12

FOREIGN PATENT DOCUMENTS 124330 11/1984 European Pat. Off. .
209771 7/1986 European Pat. Off. .
322132 6/1989 European Pat. Off. .
2111256 6/1983 United Kingdom .
2191022 12/1987 United Kingdom .

OTHER PUBLICATIONS

EP A 0 339 135, Dec. 1988.
Abstract, Japan vol. 017, No. 520 (M–1482) and JP A 05 138332, Sep. 1993.

*Primary Examiner*—Carl D. Price
*Attorney, Agent, or Firm*—William H. Holt

[57] ABSTRACT

Apparatus provides an air/fuel mixture to a fully premixed burner (4) and comprises a fuel line for providing fuel to the burner (4) a fan for supplying air at a variable flow rate to the fuel to form the mixture, a sensor (30) for sensing aeration of the fuel combustion products and a controller (26) for controlling the air flow rate in dependence upon the aeration sensed in such a way that the air flow rate is sufficient to maintain the aeration at or close to a predetermined value, the controller, in use, maintaining the air flow rate at one of a number of differing predetermined values which are in the form of a geometric series characterized by a constant value of the ratio between successive values.

20 Claims, 1 Drawing Sheet

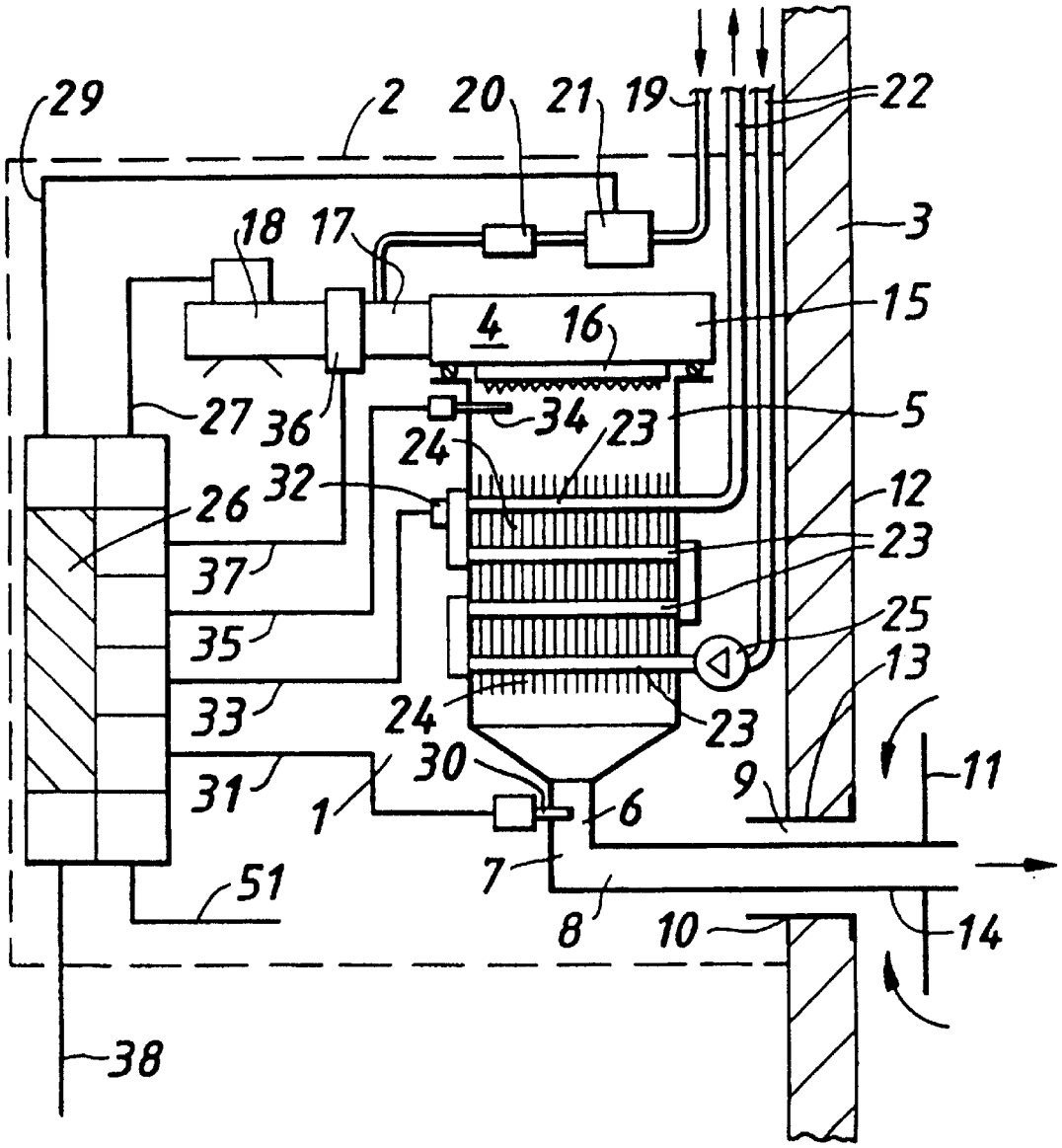
29
2
20
21
19
22
3
18
17
15
4
16
27
36
34
5
24
23
32
12
26
23
37
25
35
13
33
24
23
30
11
31
1
6
9
7
51
8
10
14
38

APPARATUS FOR PROVIDING AN AIR/FUEL MIXTURE TO A FULLY PREMIXED BURNER

BACKGROUND OF THE INVENTION

The present invention relates to apparatus for providing an air/fuel mixture particularly an air/fuel gas mixture to a fully premixed burner.

In such a burner fuel gas is mixed, before combustion in the burner, with air in a plenum chamber.

The fuel gas is usually supplied from a main while the air is supplied by a fan.

To prevent incomplete combustion of the fuel gas and the production of poisonous carbon monoxide gas, the volume flow rate of air is usually intended to be maintained in excess of the rate theoretically necessary for full combustion of the gas. Typically this excess amounts to 30%, and the burner is then said to be operating with 130% of the stoichiometric air requirement or, for brevity, "at 130% aeration".

SUMMARY OF THE INVENTION

According to the present invention, apparatus provides an air/fuel mixture to a fully premixed burner, the apparatus comprising means for providing fuel to the burner, means for supplying air at a variable flow rate to the fuel to form the mixture, means for sensing aeration of fuel combustion products and control means for controlling the air flow rate in dependence upon the aeration sensed such that the air flow rate is sufficient to maintain the aeration at or close to a predetermined value, the controller, in use, maintaining the air flow rate at one of a number of differing predetermined values which are in the form of a geometric series characterised by a constant value of the ratio between successive values.

Suitably the geometric series contains a predetermined number $N_{max}$ of terms, each term being in accordance with the following relationship:

$$Q_N = Q_1 \times R^{(N-1)}$$

Where:

- $Q_N$ is the air flow rate at the Nth step in the predetermined series of steps,
- $Q_1$ is the air flow rate at step one in the series and therefore constitutes the lowest of the permitted rates of flow,
- R is a constant term equal to the common ratio of the geometric series, the value of R being chosen according to the resolution desired between successive steps in flow rate, and
- N is a number uniquely identifying any individual step and having a lowermost value of unity and an uppermost value of $N_{max}$, the latter being determined jointly by the chosen value of the constant R and the ratio of magnitude between the highest and lowest air flow rates to be provided.

Conveniently the constant R is allocated a value of 1.025.

The advantage of making a change on the basis of a geometric series of flowrate values is that in making an adjustment to a physio-chemical process such as combustion, one can institute such an alteration as a percentage change in the existing value of the flowrate.

Preferably the means for supplying air at a variable rate comprises a variable speed fan, but may alternatively comprise a variable throttle valve.

Suitably the means for sensing aeration comprises a sensor for sensing the oxygen content of the fuel combustion products and for providing a signal representative of the oxygen content.

An embodiment of the present invention will now be described by way of example with reference to the accompanying drawings.

BRIEF DESCRIPTION OF THE DRAWING

FIG. 1 which is a schematic view of a domestic combustion system in a gas-fired domestic heating appliance, together with control apparatus therefor.

DETAILED DESCRIPTION OF THE INVENTION

Referring to FIG. 1, there is illustrated a domestic combustion system which comprises a gas boiler 1 located within a room-sealed casing 2 mounted on the inner surface of an outside wall 3 of a dwelling. The boiler 1 includes a fully-premixed gas burner 4 mounted on and sealed to an enclosure 5, the gas burner being designed to fire downwardly into an uppermost part of the enclosure 5 which forms a combustion chamber.

The enclosure 5 terminates in a lowermost flue 6 which has a vertical part 7 immediately beneath the enclosure and a horizontal part 8 connected to the vertical part 7 and extending with a clearance 9 through a hole in the wall 3. The clearance 9 is formed by the horizontal part of a flanged outlet 10. The horizontal part 8 of the flue has a circumferential flange 11 spaced from the outer surface 12 of the wall 3. The flange 11 forms with a flanged guard 13 in the wall surrounding the clearance 9 and the outer surface 14 of the horizontal flue part 8 an air intake of the so-called "balanced flue" variety.

The burner 4 has a plenum chamber 15 beneath which is located the burner plate 16. Upstream from the plenum chamber 15 is a mixing chamber 17 where the air and fuel gas meet and mix before combustion.

Air for the burner 4 is provided by a variable-speed fan 18 connected to the mixing chamber 17. Fuel gas for the burner 4 is supplied by a gas supply pipe 19 which connects to the mixing chamber 17. The gas is supplied from a pressurised main in a conventional manner via the shut-off gas valve 20.

Pipework 22 is provided to supply cold water to and remove heated water from the boiler 1, a portion 23 of the piping 22 being in serpentine form and located mainly in the enclosure 5 to enable the water to be heated by the combustion products, the part 23 having finning 24 to improve heat exchange between the combustion gases and the water. Water is pumped through parts 22, 23 and around a hot water and central heating system (not shown) by a water pump 25.

The combustion system is controlled by a control means or controller in the form of a microelectronic control box 26. This controls the fan 18 via a line 27 and the gas shut-off valve 21 via a line 29. The valve 21 is in series with a fixed flow restrictor orifice 20, the size of the orifice being selected from a predetermined range according to the rate of fuel gas flow (and so, heat output) desired. The orifice 20 may be placed separately from the valve 21 as shown. Alternatively and more conveniently, it may be incorporated within the valve 21.

An oxygen-detecting combustion sensor 30 is located in the vertical part 7 of the flue 6. The sensor 30 forms part of a so called "closed-loop" system for air/gas ratio control, supplying to the control box 26 via a line 31 an output voltage signal, the magnitude of which is directly related to the oxygen concentration in the flue gas and therefore, to the aeration in the combustible air/gas mixture, since air is admitted into the enclosure 5 only through the burner plate 16, as a constituent of the mixture produced in the chamber 17.

A hot water temperature sensor 32 located on an external part of the pipe portion 23 delivers a voltage signal to the control box 26 via a line 33. If the water temperature is excessive, the controller 26 will close the valve 21 via the line 29, preventing further operation of the burner 4 until the water temperature has fallen to some lower value.

A combined igniter and flame failure detector 34, located immediately beneath the burner plate 16, communicates bi-directionally with the control box 26 by means of a line 35. The device 34 is a standard feature forming no part of the present invention, it being mentioned for completeness only.

Between the fan 18 and the mixing chamber 17 there is mounted a differential-pressure-sensing assembly 36 comprising a diaphragm-operated switch fitted with changeover contacts and an orifice plate through which the air flow for combustion passes, consequently falling in pressure by an amount related in a predictable manner to the rate of air flow. The diaphragm is located within a chamber which is thereby divided into two compartments, each of which is connected to a different side of the orifice plate, but is otherwise sealed. The diameter of the diaphragm is chosen to be such that the moving finger of the switch (not shown) will disengage from the zero-pressure (or "rest") contact and engage the pressure contact when the pressure difference across the diaphragm rises to a chosen magnitude; and the diameter of the orifice is selected so that this magnitude will be attained at some predetermined rate of air flow, under some particular set of operating conditions. The switch when activated at a predetermined air flow rate promoted by the fan 18 delivers a signal along line 37 to the control box 26 for purposes to be subsequently described.

A signal indicative of a demand for heat is supplied to the control box 26 along line 38 from a suitable external source, not shown.

In the present embodiment, the variable-speed fan 18 is an off-the-shelf item incorporating a brushless direct current motor and a sensor for supplying to the control box 26 signal pulses proportional in frequency to the rotational speed of the fan 18. The control box 26 supplies power and a control signal to the motor and receives pulses from the speed sensor, all via the multicore line 27. The control signal is supplied as a train of rectangular pulses of 1000 Hz frequency generated by the control box 26, the duration $L_{cp}$ of each 0–5V pulse of the train being variable by the control box 26 over the range 0.0000–0.0010 second to control the speed of the fan 18. The time interval between successive pulses from the speed sensor is measured by the control box 26, translated into a rotational speed in revolutions per minute and encoded. This value is then compared with a series of similarly encoded reference fan speed values held in ROM in the control box 26, and any difference existing between the sampled and any selected one of these reference values is reduced to zero by adjustment of the duration of the control pulses supplied to the motor of the fan 18. In this way the control 26 is able to obtain and maintain a fan speed corresponding to the selected reference fan speed. In a combustion system of the type shown in FIG. 1, if other factors remain constant, the rate of air flow is very nearly proportional to the rotational speed of the fan. Therefore, provided that the performance of the fan is sufficient under the given conditions, the control box 26 will be able to procure, very nearly, any one of a selection of alternative air flow rates by adjusting the duration $L_{cp}$ of the control pulses so as to equalise the corresponding reference fan speed value and the actual fan speed value implied by the signal from the sensor on the fan 18.

Referring to Table 1, this illustrates schematically the first 12 rows of a data look-up table which is stored in ROM in the control box 26.

The first column of the table comprises "N", the step number representing the number of a term in the geometric series which forms the basis of flow control in the present invention as described above.

The second column in the table comprises the respective air flow rate Q in cubic meters/hour ($m^3$/h) corresponding to each particular step number N. The steps shown cover a range of air flow rates between a minimum of 13.5 $m^3$/hr and 17.7 $m^3$/hr at step N=12. The flow rate at each step is approximately 2.5% greater than that at the preceding step, reflecting the intended value (1.025) of the common ratio of the geometric series.

The third column in the table comprises the respective fan speed F in revolutions per minute (rev/min) corresponding to each value of N in column 1 of the look-up table. The steps shown cover fan speeds ranging from 2250 rev/min at N=1 to 2952 rev/min at N=12. The fan speed at each step is 2.5% greater than that at the preceding step.

The fourth column in the table comprises the nominal duration of the fan speed control pulses in microseconds corresponding to each value of N, as supplied on line 27.

The fifth and sixth columns in the table comprise respectively the minimum allowable value $(V^*_{cs})_L$ and the maximum allowable value $(V^*_{cs})_U$ of output voltage from the sensor 30.

In constructing such a table, depending on the desired gas flow rate a nominated air flow rate and fan speed are selected to provide a predetermined air/gas flow rate ratio corresponding to an intended percentage aeration of the combustible mixture, given fuel gas of an assumed theoretical air requirement for combustion ($m^3$ air/$m^3$ fuel gas) and a fan of assumed performance characteristics operating normally in a combustion system of an assumed flow resistance characteristic. To compensate for the occurrence in practice of departures from the particular circumstances assumed in constructing the look-up table, values of air flow rate and fan speed higher than the respective nominated value are included in the table, these values being used as necessary by methods described later. In this way the concentration of oxygen in the vicinity of the sensor 30 and so, the percentage aeration of the combustible mixture, may be made to remain as intended, despite changes in the circumstances of operation, provided that such changes are within the scope of the data in the look-up table.

For ease of explanation, the data of Table 1 are shown as ordinary numbers. In reality, however, all tabular data are stored in digital form, in keeping with normal practice. Furthermore it will be appreciated that columns 3 and 5 may contain entries up to a value of $N_{max}$ higher than that to which entries in columns 2 and 4 extend.

The program followed by the control box 26 in the present embodiment will not be described in outline.

A key to all the symbols used in the description is shown in Table 2.

The program starts by resetting to zero in RAM, for later program purposes, a parameter $C_{FS}$ described below. It then reads the line 38, to find whether there exists on the line a voltage at least equal to a preset value $V_{min}$. If such a voltage is present, this indicates the existance of a demand for heat from the external source. In that case, the control box 26 will carry out routine safety checks as in known combustion controllers. If these indicate danger, a value of zero will be stored into RAM for a signpost variable S and all further action will be suspended in a state of "lockout" until the user directs the program back to its startpoint by pressing a conventional "reset" switch on the control box 26, this also causing the program to change the value of S to unity.

If the safety checks reveal no hazard, the control box 26 will find from ROM the value of $(N_{CO})^*$, a reference step number denoting a fan speed assumed sufficient for actuation of the changeover switch in the assembly 36 when the lookup table was constructed. The control box 26 will then generate and supply along the line 27 a train of fan speed control pulses as described earlier, the duration $L_{cp}$ of these pulses being that listed in Column 4 of the look-up table, in the row for $N=(N_{co})^*$. When the speed of the fan 18 has become steady, the control box 26 will determine whether a voltage exists at the pressure contact of the changeover switch in the assembly 36. If there is none, the value of $L_{cp}$ in relation to the maximum value of 0.0010 second is checked; and as $L_{cp}$ will not be at the maximum value at this stage, the control box 26 will increase $L_{cp}$, pause suitably for a change in fan speed to occur and re-examine the pressure contact of the changeover switch. This will continue until either a voltage appears at this contact, or the value of $L_{cp}$ becomes 0.0010 second. In the latter event, in the interest of safety, the control box 26 will set S=O, $L_{cp}$=O and "lockout", as described above.

In the alternative event, however, the control box 26 will measure the value of $L_{cp}$ and find from the look-up table the associated nominal step number $(N_{cp})_{CO}$. This number is then stored into RAM for convenience if more than one attempt to light the burner should prove necessary, or if the flame should become extinguished at some time after the burner has come into operation. The control box 26 will then measure the fan speed F, and find from the look-up table, and store into RAM, the corresponding step number $N=N_{CO}$. It will next look-up the value of $(N_{CO})^*$ and evaluate the flow switch fan speed correction factor $C_{FS}$ from the Equation:

$$C_{FS}=N_{CO}-(N_{CO})^* \quad (1)$$

The factor $C_{FS}$ will be stored into RAM for use later, as will be described. If the circumstances of operation happened to accord exactly with those assumed in constructing the look-up table, $C_{FS}$ would be zero.

After a pause of $t_p$ seconds during which fresh air is blown through the combustion system to purge it of residual products from previous combustion and of any traces of fuel gas which may have leaked in through the closed valve 21, the control box 26 will estimate, and store into RAM, the fan speed step number for operation $N=N_{op}$, given by the Equation:

$$N_{op}=A+B+C_{FS} \quad (2)$$

where

A=a constant, equal to 1 or more, preset during manufacture or installation of the control box 26 according to the predetermined rate of fuel flow to be provided by the restrictor orifice within, or otherwise in series with, the valve 21, any such rate of flow being compatible with one of the predetermined values of air flow rate stored in the look-up table, and B=a constant preset in manufacture or on installation according to the expected degree of variation in properties of the fuel gas to be used by the burner 4, the value of the constant being chosen from a range of values compatible with the predetermined values of air flow rate stored in the look-up table.

If no significant variation in fuel gas properties is expected to occur, the constant B would be preset to zero. If, however, an increase of, say, up to 10% in Wobbe Number was expected, a value B=+2 might be selected, assuming that the look-up table is constructed for fuel gas of the lowest Wobbe Number likely to be distributed. With R=1.025 for the geometric series, setting B=+2 implies that the air/gas flow rate ratio would be increased by 5%. In the "open-loop" control phase the aeration of the combustible mixture would then shown a ±5% variation from the intended figure as the Wobbe Number of the fuel gas varied.

The control box 26 will now lookup in the table the nominal value of $L_{cp}$ for the step number $N=N_{op}$ and supply pulses of this duration on the line 27. Next it will measure the steady fan speed F resulting in due course and again consult the look-up table to find the corresponding step number $N=N_F$. If $N_F$ differs from $N_{op}$, the duration of the control pulses will be altered and the process repeated until the difference is removed. This being achieved, the control box 26 will cease to adjust $L_{cp}$, measure the value arrived at and find from the look-up table, and store into RAM, the corresponding step number $N=(N_{cp})_{op}$. It will then energise firstly the igniter of the device 34 and, via the line 29 a few seconds later, the coil of the gas shutoff valve 21, enabling fuel gas to flow to the burner 4 at the intended rate. If after a time $t_i$ seconds no flame is sensed by the detector of the device 34, the control box 26 will turn off the power supply to the igniter and to the valve 21.

Next the control box 26 will recall from RAM the value of I, an ignition attempt index which may be allocated a value of zero of unity by the program, as circumstances require. In the present instance, as no previous attempt at ignition had been made the stored value of I will be zero, so the program will update I to unity and try again to establish a flame on the burner 4. To do so it will recall from RAM the step number $N=(N_{cp})_{CO}$, lookup the corresponding value of $N_{cp}$, supply control pulses of this duration and repeat the steps described above in relation to the initial attempt at ignition. In the course of this, the parameters $N_{CO}$, $(N_{cp})_{CO}$ and $C_{FS}$ will be revised if necessary, or alternatively, the control box 26 will establish "lockout" in the manner described above if the control pulse duration should rise to its maximum value of 0.0010 second without a voltage appearing at the pressure contact of the changeover switch. If a flame fails to appear on the second attempt, since now I=1 the control box 26 will set S=O, $L_{cp}$=O and then "lockout". If flame is established in either attempt, however, the igniter will be de-energised and a value I=O will be stored into RAM.

For safety, the control box 26 will now check whether, with the igniter off, a flame remains present at the detector of the device 34. If it does not, one attempt will be made to relight the flame. To do this the control box 26 will turn off the power supply to the valve 21, store a value I=1 into RAM and go through the remainder of the procedure described above for a second ignition attempt.

If flame does exist at the detector, the control box 26 will read the line 38, to establish whether there is still a demand for heat. If, unusually, there is no longer any demand, the control box will turn off the supply of power to the valve 21, set $L_{cp}$=O to stop the fan and await the emergence of a new demand for heat. If, however, the demand still exists, the control box 26 will carry out certain standard safety checks. Should these reveal some hazard, the program will set S=O, de-energise the valve 21, set $L_{cp}$=O and go to "lockout".

Assuming for the present purpose that the safety checks are completed successfully, however, the control box 26 will start a timer for the "closed-loop" control operating phase and then pause for a period of t' seconds, during which further routine safety checks will be performed while conditions stabilise at the combustion sensor 30. If no hazard is detected in this process, and if the demand for heat persists, at the end of the time t* the control box 26 will sample and encode the voltage $V_{cs}$ on the line 31 and compare the result with the encoded reference voltages $(V^*_{cs})_L$, $(V^*_{cs})_U$ in Columns 5 and 6 respectively of the look-up table, in the row for the working value $N=N_{op}$. Three alternative possibilities arise.

If the voltage on the line 31 is found to be less than the lower of the two stored reference voltages, this means that the air/gas flow rate ratio is less than is appropriate. In that case the control box 26 will recall $(N_{cp})_{op}$, lookup the value of $N_{max}$ and estimate the difference $[N]_2=[N_{max}-N_{cp})_{op}]$.

If this is at least two, the control box 26 will estimate and store into RAM a new value of the parameter $(N_{cp})_{op}=[(N_{cp})_{op}+2)]$, identify from the look-up table the corresponding value of the control pulse duration $L_{cp}$ and generate and despatch along the line 27 pulses of this duration, to increase the speed of the fan 18. If $[N]_2$ is less than two, however, the control box 26 will store $(N_{cp})_{op}=N_{max}$ and generate and despatch along the line 27 control pulses of duration 0.0010 second, to increase the speed of the fan 18 to the maximum. In either case, after a further settling time t* has elapsed without any hazard arising, the control box 26 will again sample and encode the voltage on the line 31 from the combustion sensor 30 and compare the result with the reference voltages stored in Columns 5 and 6 of the look-up table, in the row for the setting $N=N_{op}$. If the sampled voltage is still less than the lower of the two stored reference voltages, the control box 26 will recall $(N_{cp})_{op}$ from store. If this is less than $N_{max}$, the above procedure will be repeated until either the sampled voltage becomes equal to or slightly exceeds $(V^*_{CS})_L$, or alternatively the recalled value of $(N_{cp})_{op}$ equals $N_{max}$. In the latter event, the control box 26 will de-energise the shut-off valve 21, set S=0, $L_{cp}$=0 and "lockout".

As the second possibility, if when sampled and encoded the voltage on the line 31 is found to be greater than the higher of the two stored voltages, this implies that the air/gas flow rate ratio is greater than is appropriate. In this case the control box 26 will recall the existing control pulse step number $(N_{cp})_{op}$ from RAM and establish whether its value is less than three.

If it is not, the control box 26 will estimate a new value $(N_{cp})_{op}=[(N_{cp})_{op}-2]$ and store this into RAM. From the look-up table the control box will identify the corresponding value of $L_{cp}$, and it will then generate and despatch along the line 27 control pulses of this duration, to decrease the speed of the fan 18. When a settling time t* has elapsed without any unsafe condition emerging, the control box 26 will again sample and encode the voltage on the line 31 from the combustion sensor 30 and compare the result with the reference voltages stored in Columns 5 and 6 of the look-up table. If the sampled voltage is still greater than the higher of the two stored reference voltages, the control box 26 will extract the altered value of $(N_{cp})_{op}$ from RAM and repeat the procedure described, until either the value of $(N_{cp})_{op}$ becomes less than three or alternatively, the sampled voltage on the line 31 assumes a value which is equal to or slightly less than the higher of the two references voltages.

If the value of $(N_{cp})_{op}$ is or becomes less than three, the control box 26 will de-energise the shutoff valve 21, set S=0, $L_{cp}$=0 and go to "lockout".

As the final possibility, if the value of the voltage on the line 31 is found to lie anywhere within the range bounded by the pair of reference voltages, the control box 26 will apply no adjustment to the air/gas flow rate ratio.

If, in any of the above circumstances, the sampled voltage on the line 31 fails to enter the intended range within a preset time t" (for example, 60 seconds) from the start of "closed-loop" operation, the control box 26 will shut the combustion system down in "lockout" until the user has pressed the "reset" switch to return the program to its startpoint. Normally, however, the sampled voltage on the line 31 will be, or will quickly become, equal to one of the two reference voltages, or to a voltage intermediate therebetween. When this occurs the control box 26 will stop the "closed-loop" timer, and return to the program point, described earlier, where it established whether flame continued to be present at the detector of the device 34 after the igniter had been switched off. From there all the foregoing steps will then be performed again in the manner described.

Should the safety checks at this point show that the demand for heat has ceased, or that the temperature at the sensor 32 on the pipe portion 23 has become excessive, the program of the control box 26 will turn off the power supply to the gas shutoff valve 21, set the control pulse duration $L_{cp}$ to zero to extinguish the flame and go to "standby", awaiting a fresh demand for heat from the external source.

On receiving this, the control box 26 will once again go through the procedure for burner startup described earlier, and in so doing will re-evaluate the factor $C_{FS}$. The new value of $C_{FS}$ will be stored into RAM, for use when Equation (2) is employed. By this means the control system can take account, prior to igniting the burner, of any change in the fan performance or in the system flow resistance characteristic which may be relevant. Furthermore, at this stage an allowance may be made, via use of the index B in Equation (2), for variability in the properties of the fuel gas.

By later adjusting $L_{cp}$ according to the magnitude of the sampled voltage on the line 31, the control box 26 is able to modify the air/gas flow rate ratio set previously in the "open-loop" mode, when this is necessary to maintain the desired concentration of oxygen in the vicinity of the sensor 30. Such action would be needed if the theoretical air requirement of the fuel gas should differ from the figure assumed in constructing the look-up table or in allocating the value of the index B; or again, if either the performance of the fan 18 or the flow resistance characteristic of the combustion system should alter, in a long period of uninterrupted operation of the burner 4, from that which was reflected in the value of the correction factor $C_{FS}$ established during the startup process.

Importantly, because according to the present invention comprehensive compensation for alterations of circumstance (including variations in fuel gas properties) can be applied both before and after the establishment of flame, the burner 4 will function for almost all of its working time at a percentage aeration close to, or identical with, than intended by the designer. This will minimise the generation of undesireable by-products of the combustion process, and maximise the life of the burner and the performance of the equipment which it serves.

Further, from the standpoint of the user the facility in the present invention of adjusting the fan speed for burner startup is more advantageous than the conventional philosophy: in the latter, operation of the burner 4 would be prevented if the fan 18 became unable to promote, at a predetermined nominal fan speed, the rate of air flow necessary to cause a voltage to appear at the pressure contact of the changeover switch in the assembly 36.

It will be apparent to one skilled in the art that the apparatus described above may be adapted in another embodiment to provide more than one preset rate of fuel gas flow and correspondingly more than one rate of air flow. For example, to provide two-rate ("high/low") operation of the burner 4, the shutoff valve 21 may embody, or be replaced by, two independent solenoid valves, operated by separate lines from the control box 26, each such valve including a restrictor orifice, the bore of which differs in the two valves. To vary the rate of fuel flow the valves may be energised by the control box 26 either alternatively or as a parallel combination. In this embodiment the control box 26 would be programmed to select appropriately one of two suitable preset constants $A_1$ and $A_2$ for use in Equation (2) with a common preset value of the constant B. In this way the resulting "open-loop" air/gas flow rate ratio may be as is required for satisfactory operation of the burner 4 at each of the rates of fuel gas flow.

It will be appreciated that in practice most operations in the control of heating and combustion involve responding to, or making, percentage changes in variables, rather than absolute-magnitude changes. For such a purpose a geometric-series-based control scheme is ideally suitable, since a geometric series is characterised by a fixed ratio between successive terms in the series; in other words, there is a fixed percentage difference between such terms. Therefore to make, for instance, an increase of X% in a variable, it will be necessary to advance through the series by roughly (X/100r) terms, where r is the percentage difference between successive terms of the series; or to be exact, by a number of terms C given by the formula:

$$C = \frac{\text{Log}(1 + X/100)}{\text{Log } R} \tag{3}$$

where

R is the common ratio of the geometric series.

Log denotes the logarithm of the quantities shown, to any desired base.

The percentage change X may, of course, be negative in value, in which case the quantity C will define the number of terms to be traversed from the existing term back towards the beginning of the series.

The number C may therefore be viewed as an algebraically additive correction factor to the term denoting the existing magnitude in which the change of X% is to be made. This is the principle underlying the use of Equations (1) and (2) in the "open-loop" mode and the technique for "closed-loop" fan speed adjustment, described above. By this approach, correction operations which are in essence multiplicative are transformed into additive operations, which are simpler to perform in conjunction with data from look-up tables. The necessary calculation operations can be carried out with a much lower memory capacity than would be required if, for example, an arithmetic series were used as the basis of control. This saves cost without compromising the flexibility and resolution of the control system.

In reality the choice of X is confined to values resulting from integer values of C, as non-integer values of C would have no practical meaning. By adopting a sufficiently small value for the common ratio R, the degree of resolution between the values of the controlled variable corresponding to successive terms can be made as fine as may be desired or necessary or useful in view of limitations set by imperfections in the control hardware.

TABLE 1

| (1) N | (2) Q ($m^3$/h) | (3) F (rev/min) | (4) $L_{ep}$ ($\mu$sec) | (5) $(V^*_{es})_L$ (volts) | (6) $(V^*_{es})_U$ (volts) |
|---|---|---|---|---|---|
| 1 | 13.5 | 2250 | 23 | 0.86 | 0.94 |
| 2 | 13.8 | 2306 | 25 | 0.86 | 0.94 |
| 3 | 14.2 | 2364 | 27 | 0.86 | 0.94 |
| 4 | 14.5 | 2423 | 29 | 0.86 | 0.94 |
| 5 | 14.9 | 2484 | 31 | 0.86 | 0.94 |
| 6 | 15.3 | 2546 | 33 | 0.86 | 0.94 |
| 7 | 15.7 | 2609 | 36 | 0.86 | 0.94 |
| 8 | 16.0 | 2675 | 39 | 0.86 | 0.94 |
| 9 | 16.4 | 2741 | 41 | 0.86 | 0.94 |
| 10 | 16.9 | 2810 | 45 | 0.86 | 0.94 |
| 11 | 17.3 | 2880 | 48 | 0.86 | 0.94 |
| 12 | 17.7 | 2952 | 52 | 0.86 | 0.94 |

TABLE 2

| Key to Symbols | |
|---|---|
| A | Gas flow rate factor preset in value during manufacture or installation of the control box. |
| B | Fuel variability factor preset in value during manufacture or installation of the control box. |
| C | Number of terms to be traversed to make a change of X % in a variable controlled in accordance with a geometric series. |
| $C_{FS}$ | Updated value of the flow switch fan speed correction factor, defined by Equ. 1. |
| F | Actual fan speed (rev/min). |
| I | Ignition attempt number, having a value of 0 or 1. |
| $L_{op}$ | Duration of the fan speed control pulses supplied on the line 27. |
| $[N]_2$ | Difference ($N_{max}$ - $N_{ep}$) between the maximum step number value stored in the loop-up table and the step number in use for setting the duration of the fan speed control pulses. |
| $N_{CO}$ | Step number corresponding to the fan speed at which a voltage appears at the pressure contact of the switch in the assembly 36. |
| $(N_{CO})^*$ | Nominally sufficient (reference) value of $N_{CO}$. |
| $N_{cp}$ | Step number used for setting the duration of the fan speed control pulses. |
| $(N_{cp})_{CO}$ | Step number controlling the duration of the fan speed control pulses when the fan speed step number $N_{CO}$ is achieved. |
| $(N_{cp})_{op}$ | Step number regulating the duration of the fan speed control pulses when the actual fan speed corresponds to the step number $N_{op}$. |
| $N_F$ | Step number corresponding to an actual fan speed F. |
| $N_{op}$ | Fan speed step number desired for burner operation, defined by Equ. 2. |
| $N_{max}$ | Maximum step number value stored in the look-up table. |
| r | Percentage difference between successive terms in a geometric series. |
| R | Common ratio of a geometric series. |
| S | Signpost variable routing the program to "standbby" or to "lockout", dependent upon whether its value is 1 or 0 respectively. |
| $t_i$ | Maximum permitted delay in establishing flame during the ignition process. |
| $t_p$ | Required purge time during the ignition process. |
| $t^*$ | Time allowed for the environment at the combustion sensor 30 to stabilise in composition, following an adjustment in the rate or air and/or fuel gas flow. |
| $t^{**}$ | Maximum permitted time for completion of "closed-loop" action. |

TABLE 2-continued

| Key to Symbols | |
|---|---|
| $V_{es}$ | Output voltage provided by combustion sensor 30. |
| $(V^*_{es})_L$ | Minimum allowable value of output voltage from sensor 30. |
| $(V^*_{es})_U$ | Maximum allowable value of output voltage from sensor 30. |
| $V_{min}$ | Minimum value or output voltage from external source, indicative of a demand for heat. |
| X | Percentage change in a variable. |

I claim:

1. Apparatus for providing an air/fuel mixture to a fully premixed burner comprising means for providing fuel to the burner, means for supplying air at a variable flow rate to the fuel to form the mixture, means for sensing aeration of fuel combustion products and control means for controlling the air flow rate in dependence upon the aeration sensed such that the air flow rate is sufficient to maintain the aeration at substantially a predetermined value, said control means, in use, maintaining the air flow rate at one of a number of different predetermined values which are in the form of a geometric series characterised by a constant value of the ratio between successive predetermined values.

2. Apparatus as claimed in claim 1 in which the means for supplying air at a variable rate comprises a variable speed fan.

3. Apparatus as claimed in claim 2 in which the predetermined value of fan speed associated with any predetermined value of fuel gas flow rate is automatically variable to maintain the rate of air flow and the rate of gas flow at, or substantially at, an intended ratio, should the resistance to flow or the performance of the fan alter.

4. Apparatus as claimed in claim 2 in which the predetermined value of fan speed associated with any predetermined value of fuel gas flow rate is preadjustable according to an expected degree of variation in the properties of the fuel gas to minimize the change in the aeration of the fuel/air mixture should the expected variation in fuel gas properties occur.

5. Apparatus as claimed in claim 4 in which the constant R is allocated a value of 1.025.

6. Apparatus as claimed in claim 2 including adjustment means comprising a predetermined operating program for preadjusting the value of said fan speed.

7. Apparatus as claimed in claim 1 in which the means for supplying air at a variable rate comprises a throttle valve.

8. Apparatus as claimed in claim 1 in which the means for sensing aeration comprises a sensor for sensing the oxygen content of the fuel combustion products and for providing a signal representative of the oxygen content.

9. Apparatus as claimed in claim 1 in which the predetermined value of fan speed associated with any predetermined value of fuel gas flow rate is automatically variable to maintain the rate of air flow and the rate of gas flow at, or substantially at, an intended ratio, should the resistance to flow or the performance of the fan alter.

10. Apparatus as claimed in claim 1 in which the predetermined value of fan speed associated with any predetermined value of fuel gas flow rate is preadjustable according to an expected degree of variation in the properties of the fuel gas to minimise the change in the aeration of the fuel/air mixture should the expected variation in fuel gas properties occur.

11. Apparatus as claimed in claim 1 in which the value of the fan speed is preadjustable by means of a predetermined operating programme.

12. Apparatus as claimed in claim 1 in which the geometric series contains a predetermined number $N_{max}$ of terms, each term being in accordance with the following relationship:

$$Q_N = Q_1 \times R^{(N-1)}$$

where:

$Q_N$ is the air flow rate at the $N_{th}$ step in the predetermined series of steps, $Q_1$ is the air flow rate at step one in the series, R is a constant term equal to the common ratio of the geometric series, the value of R being chosen according to the resolution desired between successive steps in air flow rate, and N is a number uniquely identifying any individual step and having a lowermost value of unity and an uppermost value of $N_{max}$, the latter being determined jointly by the chosen value of the constant R and the ratio of magnitude between the highest and lowest air flow rates to be provided.

13. Apparatus as claimed in claim 12 in which the means for supplying air at a variable rate comprises a variable speed fan.

14. Apparatus as claimed in claim 12 in which the means for supplying air at a variable rate comprises a throttle valve.

15. Apparatus as claimed in claim 12 in which the means for sensing aeration comprises a sensor for sensing the oxygen content of the fuel combustion products and for providing a signal representative of the oxygen content.

16. Apparatus as claimed in claim 12 in which the constant R is allocated a value of 1.025.

17. Apparatus as claimed in claim 16 in which the means for supplying air at a variable rate comprises a variable speed fan.

18. Apparatus as claimed in claim 16 in which the means for supplying air at a variable rate comprises a throttle valve.

19. Apparatus as claimed in claim 16 in which the means for sensing aeration comprises a sensor for sensing the oxygen content of the fuel combustion products and for providing a signal representative of the oxygen content.

20. Apparatus as claimed in claim 3 in which the constant R is allocated as value of 1.025.

* * * * *